US005579100A

United States Patent [19]

Yu et al.

[11] Patent Number: 5,579,100

[45] Date of Patent: Nov. 26, 1996

[54] SINGLE POSITIVE RECHARGE METHOD AND APPARATUS FOR COLOR IMAGE FORMATION

[75] Inventors: Zhao-Zhi Yu, Webster; Charles H. Tabb, Penfield; John F. O'Brien, Fairport; James R. Beachner, Webster; Mark A. Gwaltney, Fairport; Meng H. Lean, Briarcliff Manor; Jeffrey J. Folkins, Rochester, all of N.Y.

[73] Assignee: Xerox Corporation, Stamford, Conn.

[21] Appl. No.: 363,081

[22] Filed: Dec. 23, 1994

[51] Int. Cl.[6] ..... G03G 15/01

[52] U.S. Cl. ..... 355/326 R; 355/328

[58] Field of Search ..... 355/208, 219, 355/221, 246, 326 R, 327, 328; 118/645

[56] References Cited

U.S. PATENT DOCUMENTS

| | | | |
|---|---|---|---|
| 4,033,688 | 7/1977 | Orthmann | 355/233 |
| 4,141,648 | 2/1979 | Gaitten et al. | 355/225 |
| 4,432,631 | 2/1984 | Bacon et al. | 355/225 |
| 4,660,059 | 4/1987 | O'Brien | 346/157 |
| 4,761,669 | 8/1988 | Langdon | 355/326 R |
| 4,791,452 | 12/1988 | Kasai et al. | 355/326 R |
| 4,819,028 | 4/1989 | Abe | 355/326 R |
| 4,833,503 | 5/1989 | Snelling | 355/259 |
| 4,868,611 | 9/1989 | Germain | 355/328 |
| 5,061,969 | 10/1991 | Parker et al. | 355/328 |
| 5,208,636 | 5/1993 | Rees et al. | 355/219 |
| 5,241,356 | 8/1993 | Bray et al. | 355/328 |
| 5,258,820 | 11/1993 | Tabb | 355/328 |
| 5,438,401 | 8/1995 | Murayama et al. | 355/326 R |

FOREIGN PATENT DOCUMENTS

| | | | |
|---|---|---|---|
| 60-50553 | 3/1985 | Japan | 355/328 |
| 1-340663 | 9/1991 | Japan . | |

*Primary Examiner*—William J. Royer

*Attorney, Agent, or Firm*—Leslie A. Weise; John M. Kelly

[57] ABSTRACT

In a multi-color imaging apparatus utilizing a recharge step between two image creation steps, a corona generating device is used to recharge the developed image areas and untoned areas of a charge retentive surface to a lower electrical potential than that associated with the developed image areas before recharge, so that the residual voltage associated with the developed image is substantially reduced and a minimal level of negative charge is driven through the toner layer(s). An electrical charge associated with any previously developed images is substantially neutralized prior to development of any subsequent images thereon.

24 Claims, 3 Drawing Sheets

SINGLE POSITIVE RECHARGE METHOD AND APPARATUS FOR COLOR IMAGE FORMATION

BACKGROUND OF THE INVENTION

This invention relates generally to color imaging and more particularly to the use of plural exposure and development steps for such purposes.

Several different methods exist for printing multi-color images. One method of printing in different colors is to uniformly charge a charge retentive surface and then optically expose the surface to information to be reproduced in one color. This information is rendered visible using marking particles followed by the recharging of the charge retentive surface prior to a second exposure and development. This recharge/expose/and develop (REaD) process may be repeated to subsequently develop images of different colors in superimposed registration, whereby a full color image is created on the surface before being subsequently transferred to a support substrate. The different colors may be developed on the photoreceptor in an image on image development process, or a highlight color image development process (image next-to image). The images may be formed by using a single exposure device, e.g. ROS, where each subsequent color image is formed in a subsequent pass of the photoreceptor (multiple pass). Alternatively, each different color image may be formed by multiple exposure devices corresponding to each different color image, during a single revolution of the photoreceptor (single pass).

During the REaD image on image process of creating multi-color images, several critical issues must be addressed in the attempt to provide optimum conditions for the development of subsequent color images onto previously developed color images. Specifically, the voltages among previously toned and untoned areas of the photoreceptor must be leveled during a recharge step, so that subsequent exposure and development steps are effected across a uniformly charged surface. The greater the difference in voltage between those image areas of the photoreceptor previously subjected to a development and recharge step, and those bare non-developed, untoned areas of the photoreceptor, the larger will be the difference in print quality between these areas.

Another issue to be addressed with the image on image color image formation process is the need to substantially reduce, or eliminate, the residual charge that exists across the toner layer of a previously developed area of the photoreceptor before the subsequent exposure and development of the next color image thereon. Color quality is severely threatened by the presence of the toner charge and the resultant voltage drop across the toner layer. The residual toner voltage ($V_t$) prevents the effective voltage above any previously developed toned areas from being re-exposed and discharged to the same level as neighboring bare photoreceptor areas which have been exposed and discharged to the actual desired voltage levels. The residual voltage associated with a toned image can be responsible for color shifts, increased moire, increased color shift sensitivity to image misregistration and motion quality, and loss in latitude affecting many of the photoreceptor subsystems. These problems become increasingly severe as additional color images are subsequently exposed and developed thereon. Thus, it is ideal to reduce or eliminate the residual toner voltage of any previously developed toned images.

Additional residual problems may occur while attempting to achieve both voltage uniformity and elimination of the residual toner voltage. For example, during the recharge step, if some or all of the potential associated with the previously developed image is raised to a high level relative to subsequently exposed areas, toner spray or spread is likely to occur along the edges of the developed image in areas where the edges of the prior developed image align but do not overlap with the edges of a subsequent image. Conversely, if during the attempt to avoid toner spread, the potential associated with the developed image is brought to a lower level during recharge, whereby some or all of the toner charge is reversed in polarity, a different problem of a serious nature develops. Since the prior toner image is now predominantly of an opposite polarity to both the background bare areas and the incoming color toner to be developed thereon, an interaction occurs among these three separate and distinctly charged regions. Particularly, the reverse polarity toner image is attracted to the background areas and the toner of the incoming color image, causing the positively charged toner of the first image to splatter into neighboring bare background regions at the edges of the prior image. This occurrence has been titled the "under color splatter" defect (UCS) and is the cause for the unwanted blending of colors and the spreading of colors from image edges into background areas. The UCS defect is apparent where the prior image overlaps with the subsequent image.

In an attempt to avoid both the above mentioned problems of toner spray and UCS occurrence while realizing a reduction in $V_t$, it has been taught in the prior art to neutralize the charge of the toner layer. For example, a recharge method disclosed in copending application for U.S. patent entitled "Method and Apparatus for Reducing Residual Toner Voltage", Ser. No. 08/347,616, filed by a common assignee as the present application, discloses a recharge method wherein a voltage sensitive recharge device used for the recharging steps during a color image formation, whose graph of the output current (I) to the charge retentive surface as a function of the voltage to the charge retentive surface (V) has a high (I/V) slope. The high I/V slope recharge device disclosed having an AC voltage supplied thereto, enables an extended time for neutralization to occur at the top of the toner layers. However, the amount of residual voltage $V_t$ reduction that can be realized is limited in this system.

A recharge method disclosed in copending application for U.S. patent entitled "Split Recharge Method and Apparatus for Color Image Formation", Ser. No. 08/347,617, filed by a common assignee as the present application, discloses a recharge method wherein a corona generating apparatus recharges a charge retentive surface having at least one image developed thereon, to a predetermined voltage. A first corona generating device delivers a direct current to recharge the charge retentive surface to a higher absolute potential than the predetermined potential, which enables more opposite polarity charge to be delivered to the toner image by a second corona generating device during the neutralization process. The second corona device subsequently delivers an alternating current to the photoreceptor and toner image, to recharge the charge retentive surface to the predetermined potential and substantially neutralize the electrical charge associated with the developed image. The split recharge method disclosed in Ser. No. 08/347,617 thereby successfully enables voltage uniformity between toned and untoned regions, while substantially eliminating the residual voltage associated with the previously toned image. However, as the first (non-black) color toner deposited during the image on image process undergoes split recharge, i.e. a negative overcharging step and an AC charging step, from one to three times, a substantial amount of negative charge is driven through this first layer.

During corona charging of a toner image on a charge retentive surface, e.g. a photoreceptor belt, negative corona ions tend to drive down towards the bottom of the toner layer, and positive ions tend to stay at the top of the layer. Thus, negative charging of a toner layer causes negative charges to be forced to the bottom of, in particular, the first deposited color toner, and onto the photoreceptor surface, thereby causing potential difficulty during the attempt to transfer the toner image from the photoreceptor. It is therefore desirable to keep the particle charge level as low as possible at every stage of the image formation process.

Based on the foregoing, a highly reliable and consistent manner of recharging the photoreceptor to a uniform level is needed, whereby the residual voltage on previously toned areas is minimized and minimal negative charge is exerted on the toner particles.

The following references may be found relevant to the present disclosure.

Application for Japanese Patent No. Hei 1-340663, Application date Dec. 29, 1989, Publication date Sep. 4, 1991, assigned to Matsushita Denki Sangyo K. K. discloses a color image forming apparatus wherein a first and second charging device are used to recharge a photoconductor carrying a first developed image, before exposure and development of a subsequent image thereon. The potential of the photoconductor is higher after passing the first charging device than after passing the second charging device. This reference teaches that the difference in voltage applied by the first and second charging devices to the toner image and photoreceptor surface is set to a relatively high level, to insure that the polarity of the toner image is reversed after passing and having been charged by both devices, to reduce the residual charge in the image areas, and also to prevent toner spray during the exposure process. However, as previously discussed, the presence of reversed polarity toner at the top of the toner layer causes the serious defect of under color splatter.

U.S. Pat. No. 4,791,452 relates to a two-color imaging apparatus wherein a first latent image is formed on a uniformly charged imaging surface and developed with toner particles. The charge retentive surface containing a first developed or toned image, and undeveloped or untoned background areas is then recharged by a scorotron charging device prior to optically exposing the surface to form a second latent electrostatic image thereon. An electrical potential sensor detects the surface potential level of the drum to ensure that a prescribed surface potential level is reached. The recharging step is intended to provide a uniformly charged imaging surface prior to effecting a second exposure.

U.S. Pat. No. 4,819,028 discloses an electrophotographic recording apparatus capable of forming a clear multicolor image including a first visible image of a first color and a second visible image of a second color on a photoconductive drum. The electrophotographic recording apparatus is provided with a conventional charger unit and a second corona charger unit for charging the surface of the photoconductive drum after the first visible image is formed thereon so as to increase the surface potential of the photoconductive drum to prevent the first visible image from being mixed with a second color and also from being scratched off from the surface of the photoconductive drum by a second magnetic brush developing unit.

U.S. Pat. No. 4,761,669 relates to creating two-color images. A first image is formed using the conventional xerographic process. Thus, a charge retentive surface is uniformly charged followed by light exposure to form a latent electrostatic image on the surface. The latent image is then developed. A corona generator device is utilized to erase the latent electrostatic image and increase the net charge of the first developed image to tack it to the surface electrostatically. This patent proposes the use of an erase lamp, if necessary, to help neutralize the first electrostatic image. A second electrostatic image is created using an ion projection device. The ion image is developed using a second developer of a different color.

U.S. Pat. No. 4,033,688 discloses a color copying apparatus which utilizes a light-lens scanning device for creating plural color images. This patent discloses multiple charge/expose/develop steps.

U.S. Pat. No. 4,833,503 discloses a multi-color printer wherein a a recharging step is employed following the development of a first image. This recharging step, according to the patent is used to enhance uniformity of the photoreceptor potential, i.e. neutralize the potential of the previous image.

U.S. Pat. No. 4,660,059 discloses an ionographic printer. A first ion imaging device forms a first image on the charge retentive surface which is developed using toner particles. The charge pattern forming the developed image is neutralized prior to the formation of a second ion image by a corona generating unit and an erase lamp.

U.S. Pat. No. 5,208,636, discloses a printing system wherein charged area images and discharged area images are created, the former being formed first and the latter being proceeded by a recharging of the imaging surface.

U.S. Pat. No. 5,241,356 discloses a multi-color printer wherein charged area images and discharged area images are created, the former being formed first, followed by an erase step and a recharge step before the latter is formed. An erase lamp is used during the erase step to reduce voltage non-uniformity between toned and untoned areas on a charge retentive surface.

U.S. Pat. No. 5,258,820 discloses a multi-color printer wherein charged area images and discharged area images are created. An erase lamp is used following development of a charged area (CAD), and a prerecharge corona device is used following development of a discharged area (DAD) and prior to a recharge step, to reduce voltage non-uniformity between toned and untoned images on a charge retentive surface.

Copending application for U.S. Pat. Ser. No. 08/1346,708, filed by a common assignee as the present application, discloses a corona recharge device for recharging the photoreceptor containing at least one previously developed color image, to a voltage level intermediate to the background areas and the image areas, to keep wrong-charge toner developed in the background areas at a charge level distinct from the toner developed in the image areas so that the wrong-charge background toner does not transfer to a support substrate with the image.

A number of commercial printers employ the charge/expose/develop/recharge imaging process. For example, the Konica 9028, a multi-pass color printer forms a single color image for each pass. Each such pass utilizes a recharge step following development of each color image. The Panasonic FPC1 machine, like the Konica machine is a multi-pass color device. In addition to a recharge step the FPC1 machine employs an AC corona discharge device prior to recharge.

SUMMARY OF THE INVENTION

In accordance with the invention, a printing machine for creating multiple images is disclosed, comprising a charge retentive surface having a developed image thereon, the developed image having an electrical potential associated therewith. The machine also comprises a corona generating device for recharging the charge retentive surface to a lower electrical potential than the electrical potential associated with the developed image.

In accordance with another aspect of the invention, a method for creating an image on a charge retentive surface is disclosed. The method comprises the steps of recording a latent image on a charge retentive surface, developing the latent image, the developed image having an electrical potential associated therewith, and recharging the charge retentive surface to a lower electrical potential than the electrical potential associated with the developed image.

DETAILED DESCRIPTION OF THE PREFERRED EMBODIMENT OF THE INVENTION

This invention relates to an imaging system which is used to produce an image on image color output in a single revolution or pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass image on image color process system, and a single or multiple pass highlight color system.

Figure 1:
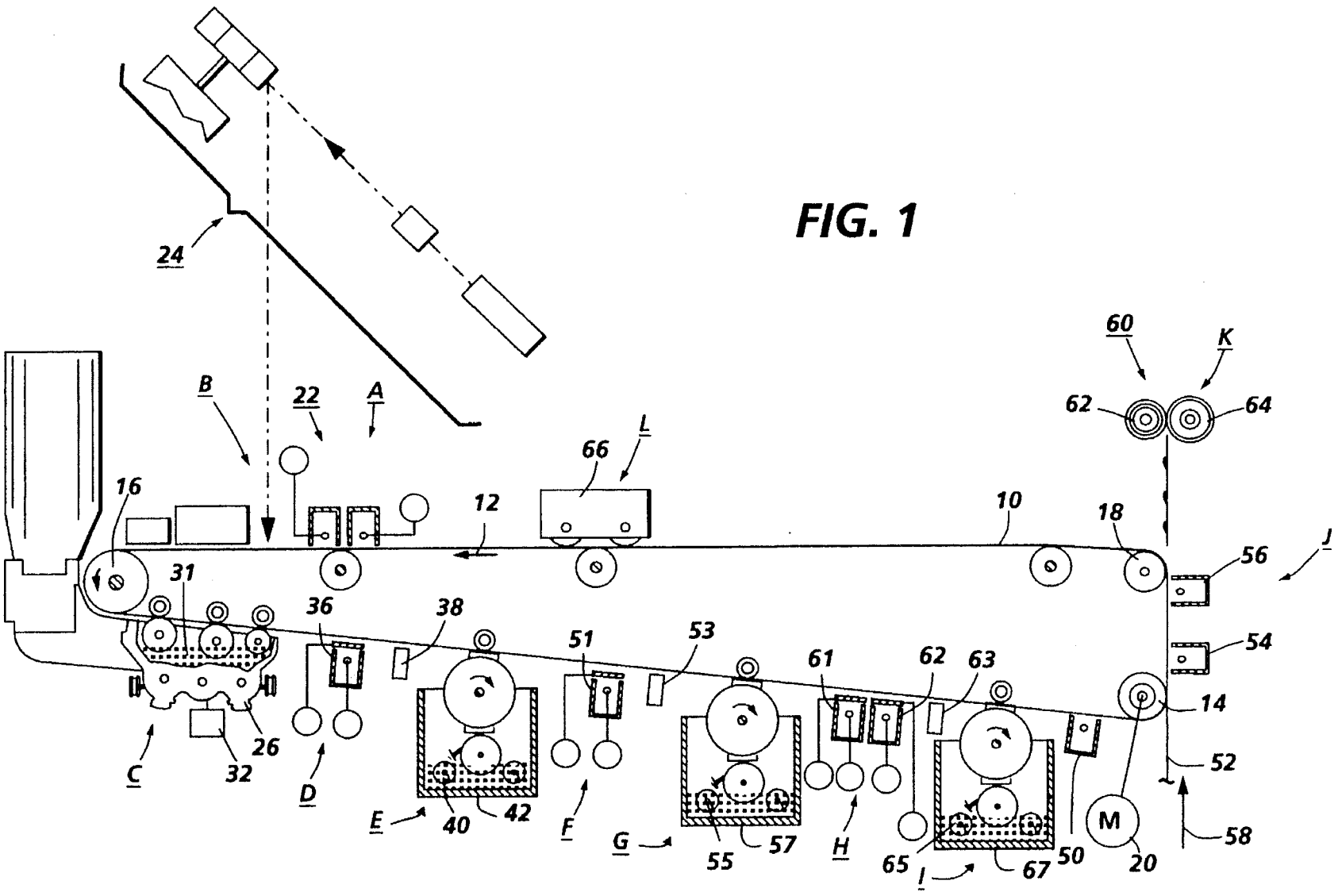
FIG. 1 is a schematic illustration of an imaging apparatus incorporating the development system features of the invention.

Turning now to FIG. 1, the electrophotographic printing machine of the present invention uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14 and two tension rollers 16 and 18 and the roller 14 is operatively connected to a drive motor 20 for effecting movement of the belt through the xerographic stations.

With continued reference to FIG. 1, a portion of belt 10 passes through charging station A where a corona generating device, indicated generally by the reference numeral 22, charges the photoconductive surface of belt 10 to a relatively high, substantially uniform potential. For purposes of example, the photoreceptor is negatively charged, however it is understood that the present invention could be useful with a positively charged photoreceptor, by correspondingly varying the charge levels and polarities of the toners, recharge devices, and other relevant regions or devices involved in the discharged area development process of image on image color image formation, as will be hereinafter described. Accordingly, it is understood that the relative potential levels that are used to describe the steps associated with the single positive recharge step of the present invention (e.g. higher and lower potential) are described in the absolute sense.

Next, the charged portion of photoconductive surface is advanced through an exposure or imaging station B. At exposure station B, the uniformly charged belt 10 is exposed to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices known in the art.

The photoreceptor, which is initially charged to a voltage $V_0$, undergoes dark decay to a level Vddp equal to about −500 volts. When exposed at the exposure station B the image areas are discharged to $V_{DAD}$ equal to about −150 volts. Thus after exposure, the photoreceptor contains a monopolar voltage profile of high and low voltages, the former corresponding to charged areas and the latter corresponding to discharged or image areas.

At a first development station C, a magnetic brush developer structure, indicated generally by the reference numeral 26 advances insulative magnetic brush (IMB) material 31 into contact with the electrostatic latent image. The developer structure 26 comprises a plurality of magnetic brush roller members. These magnetic brush rollers present, in a preferred embodiment of the present invention, negatively charged black color toner material to the image areas for development thereof. Appropriate developer biasing is accomplished via power supply 32. Electrical biasing is such as to effect discharged area development (DAD) of the lower (less negative) of the two voltage levels on the photoreceptor with the material 31.

At recharging station D, a corona recharge device 36 is employed for adjusting the voltage level of both the black toned and untoned areas of the photoreceptor surface to a substantially uniform level. Black color toner is developed first in a preferred embodiment of the image on image multi-color image formation process of the present invention, since subsequent color images are typically not developed over the image areas developed with black color toner, and therefore, the recharge issues normally present when developing over other color toners are not present during recharge of a photoreceptor surface having a black-first toner image. Thus, only one corona recharge device is needed to recharge the photoreceptor to the desired $V_{ddp}$ level (e.g. −600 volts) during the first recharge step of the black color developed image, for subsequent exposure and development of different color toner images. A power supply coupled to the electrode of corona recharge device 36 and to any grid or other voltage control surface associated therewith, serves as a voltage source to the device. The voltage profiles associated with this recharge step are described in further detail with reference to FIGS. 3A–3M.

A second exposure or imaging device 38 which may comprise a laser based output structure is utilized for selectively discharging the photoreceptor on toned areas and/or bare areas to approximately −400 volts, pursuant to the image to be developed with the second color (first non-black) developer. After this point, the photoreceptor contains toned and untoned areas at relatively high voltage levels (e.g. −600 volts) and toned and untoned areas at lower voltage levels (e.g. −400 volts), representing image areas which are to be developed using discharged area development. To this end, a negatively charged developer material 40 is employed, comprising in a preferred embodiment of the present invention, a first non-black color toner, for example, yellow. The toner is contained in a developer housing structure 42 disposed at a second developer station E and is presented to the latent images on the photoreceptor by a non-interactive developer. A power supply (not shown) serves to electrically bias the developer structure to a level effective to develop the DAD image areas with the negatively charged yellow toner particles 40.

At a second recharging station F, a single voltage sensitive corona recharge device 51 is employed for lowering the voltage level (e.g. to −300 volts), by delivering a positive current to charge both the toned and untoned areas on the photoreceptor to a substantially uniform level. A power supply coupled to the electrode of corona recharge device 51 and to any grid or other voltage control surface associated therewith, serves as a voltage source to the device. The recharge device 51 serves to level the voltages of the bare untoned regions and the toned regions of the photoreceptor, with a voltage sensitive corona recharge device, e.g. a DC scorotron, by delivering a direct positive current to the photoreceptor and developed image. Thus, only positive current has been used during this recharge step, thereby substantially reducing the residual voltage associated with the developed image and the total amount of negative charge driven through the developed image.

A third latent image is created using an imaging or exposure device 53. In this instance, a third DAD image is formed, by discharging to approximately −30 volts, those bare areas of the photoreceptor that will be developed with the third color image. Previously toned areas are discharged to a level increased by its associated $V_t$. This image is developed using a third color (second non-black color) toner 55 contained in a non-interactive developer housing 57 disposed at a third developer station G. An example of a suitable third color toner is magenta. Suitable electrical biasing of the housing 57 is provided by a power supply, not shown.

At a third recharging station H, a pair of corona recharge devices 61 and 62 are employed for raising the voltage level of both the toned and untoned areas on the photoreceptor to a substantially uniform level, and for substantially reducing the residual voltage associated with the previously developed images. A power supply coupled to each of the electrodes of corona recharge devices 61 and 62 and to any grid or other voltage control surface associated therewith, serves as a current source to the devices. The recharging devices 61 and 62 serve to substantially eliminate any voltage difference between toned areas and bare untoned areas as well as to reduce the level of residual voltage remaining on the previously toned areas, so as to minimize differential development of subsequent different color toner images. The first corona recharge device 61 overcharges the photoreceptor surface containing previously toned and untoned areas, to a level higher than the voltage level ultimately required for $V_{ddp}$, for example to −600 volts. The predominant corona charge generated from corona recharge device 61 is negative. The second corona recharge device 62 reduces the photoreceptor voltage to the desired $V_{ddp}$, −400 volts. Hence, the predominant corona charge delivered from the second corona recharge device 62 is positive. The corona recharge device types and the voltage split are selected to ensure that the charge at the top of the toner layer is substantially neutralized. This split recharge method of recharging the toned layers on the photoreceptor is described in copending application for U.S. Pat. Ser. No. 08/347,617, the relevant portions of which are hereby incorporated by reference herein. The voltage profiles associated with this recharge step are described in further detail with reference to FIGS. 3A–3M.

A fourth latent image is created using an imaging or exposure device 63. A fourth DAD image is formed on both bare areas and previously toned areas of the photoreceptor that are to be developed with the fourth color image. This image is developed with a third non-black color toner, for example, a cyan color toner 65 contained in developer housing 67 at a fourth developer station I. Suitable electrical biasing of the housing 67 is provided by a power supply, not shown.

The developer housing structures 42, 57, and 67 are preferably of the type known in the art which do not interact, or are only marginally interactive with previously developed images. For examples, a DC jumping development system, a powder cloud development system, and a sparse, non-contacting magnetic brush development system are each suitable for use in an image on image color development system. A non-interactive, scavengeless development housing having minimal interactive effects between previously deposited toner and subsequently presented toner is described in U.S. Pat. No. 4,833,503, the relevant portions of which are hereby incorporated by reference herein.

In order to condition the toner for effective transfer to a substrate, a negative pre-transfer corotron member 50 discharges negative corona to ensure that all toner particles are of the required negative polarity to ensure proper subsequent transfer.

Subsequent to image development a sheet of support material 52 is moved into contact with the toner images at transfer station J. The sheet of support material is advanced to transfer station J+ by conventional sheet feeding apparatus, not shown. Preferably, the sheet feeding apparatus includes a feed roll contacting the uppermost sheet of a stack of copy sheets. The feed rolls rotate so as to advance the uppermost sheet from the stack into a chute which directs the advancing sheet of support material into contact with the photoconductive surface of belt 10 in a timed sequence so that the toner powder image developed thereon contacts the advancing sheet of support material at transfer station J.

Transfer station J includes a transfer corona device 54 which sprays positive ions onto the backside of sheet 52. This attracts the negatively charged toner powder images from the belt 10 to sheet 52. A detack corona device 56 is provided for facilitating stripping of the sheets from the belt 10.

After transfer, the sheet continues to move, in the direction of arrow 58, onto a conveyor (not shown) which advances the sheet to fusing station K. Fusing station K includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52 after it is allowed to cool. After fusing, a chute, not shown, guides the advancing sheets 52 to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station L using a cleaning brush structure contained in a housing 66.

The various machine functions described hereinabove are generally managed and regulated by a controller (not shown), preferably in the form of a programmable microprocessor. The microprocessor controller provides electrical command signals for operating all of the machine subsystems and printing operations described herein, imaging onto the photoreceptor, paper delivery, xerographic processing functions associated with developing and transferring the developed image onto the paper, and various functions associated with copy sheet transport and subsequent finishing processes.

The recharge devices 36, 51, 61 and 62 have been described generally as corona generating devices, with reference to FIG. 1. However, it is understood that the corona generating devices for use in the present invention could be in the form of, for example, a corotron, scorotron, dicorotron, pin scorotron, or other voltage sensitive corona charging devices known in the art. In a preferred embodiment of the invention, the single positive recharge step hereinbefore described is accomplished using a voltage sensitive DC scorotron, wherein a direct positive current is delivered to the photoreceptor having the first non-black color toner image developed thereon, so that the negative charge driven through the composite image is reduced, transfer of the image from the photoreceptor is potentially improved, and the quality of the image is improved by accomplishing the stated recharge objectives of: achieving voltage uniformity between previously toned areas and untoned areas of the photoreceptor so that subsequent exposure and development steps are effected across a uniformly charged surface; reducing the residual voltage of the previously developed image areas; and applying less overall negative charge to the toner layer(s). The use of only one corona recharge device during the first and second recharge steps as described in the preferred embodiment of the present invention also has the advantageous features of providing a cost savings and a space savings to the machine, over a system incorporating a full split recharge method for each recharge step, the split recharge method being that previously described with reference to the third recharge step in the preferred embodiment of the present invention.

Several additional advantages exist by developing the black color toner image first as hereinbefore described. First, aside from the need for only one single corona recharge device during the single positive recharge step of the present invention, only one single corona recharge device is needed to recharge the photoreceptor subsequent to development of the black-first color toner image. Second, less overall toner is needed, and in particular, less non-black toner, during the image on image color composite image formation process. It is understood, however, that other color toner sequencing could be used, for example, cyan, magenta, yellow, and then black, whereby the advantages of residual toner voltage reduction, as well as reduction in negative charge exertion through the toner layer(s) are realized, by use of the present invention.

Figure 2:
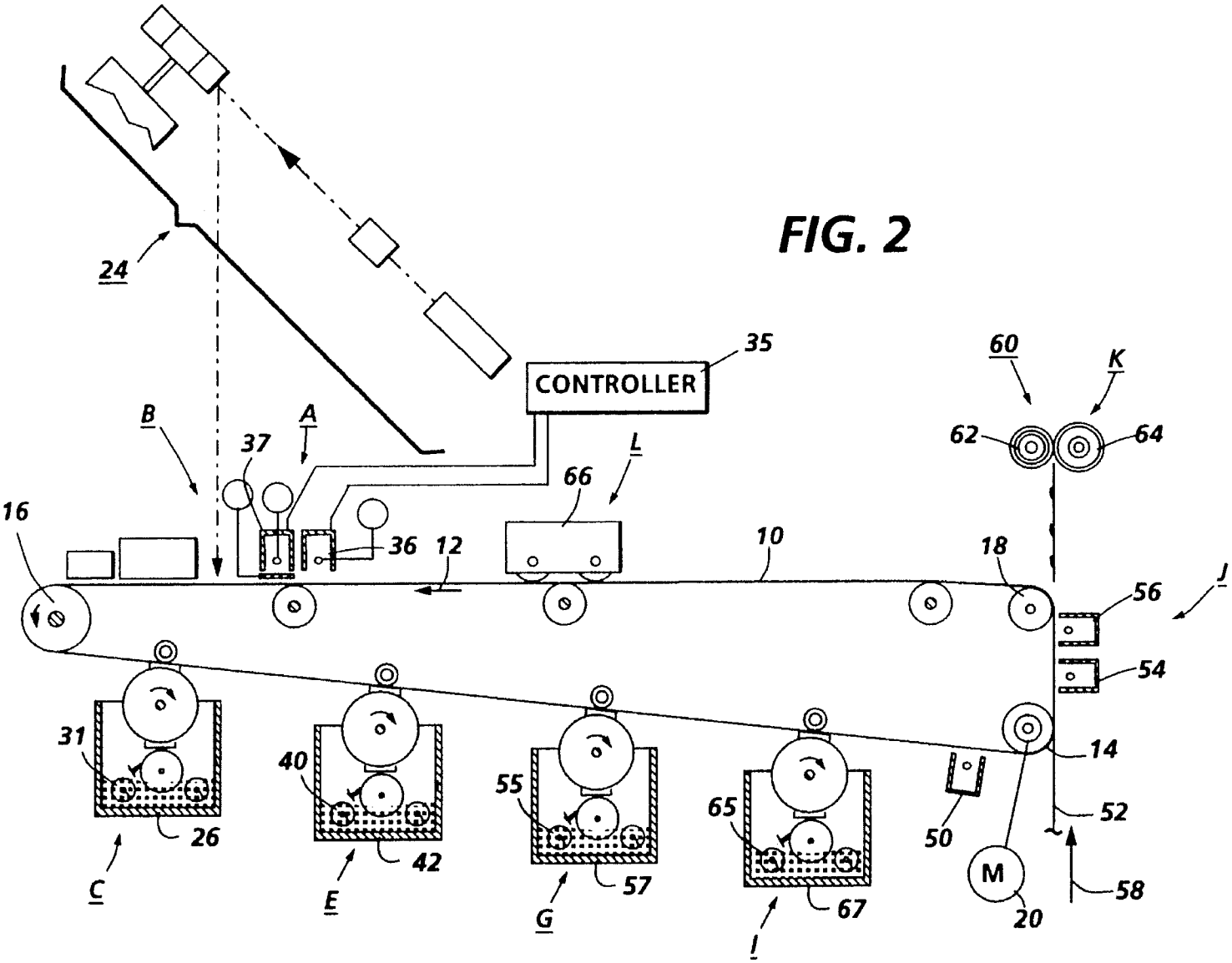
FIG. 2 is a schematic illustration of another imaging apparatus incorporating the development system features of the invention.

FIG. 2 illustrates another example of an electrostatographic printing apparatus which would find advantageous use of the present invention. FIG. 2 represents a multiple pass color image formation process, where each successive color image is applied in a subsequent pass or rotation of the photoreceptor. Like reference numerals to those in FIG. 1 correspond with identical elements to those represented in FIG. 2, with the exception that a non-interactive development system at Station C replaces the magnetic brush development system used as an example in FIG. 1, for purposes of illustration of alternate and equivalent embodiments for use with the present invention. Furthermore, in a multi-pass system as represented in FIG. 2, only a single set of recharging devices, indicated generally at charging/recharging station A, is needed to recharge the photoreceptor surface photorreceptor 10 prior to each subsequent color image formation. Although two corona recharge devices 36 and 37 are shown in FIG. 2, it is understood that by using the preferred color sequencing described with reference to FIG. 1 (i.e. black-first), a controller 35 controls the operation of recharge devices 36 and 37 so that the use of both devices is effected only when necessary, i.e. only during those recharge steps that require the split recharge process as previously described, and not after a black-first color toner development step, nor during the single positive recharge step of the present invention as hereinbefore described. In a multipass system as illustrated in FIG. 2, only a single exposure device 24 is needed to expose the photoreceptor subsequent to each color image development. It is also understood that the cleaning station L is of the type that is capable of camming away from the surface of the photoreceptor during the image formation process, so that the image is not disturbed prior to image transfer.

Figure 3A:
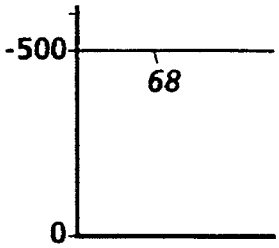
FIG. 3A shows the photoreceptor voltage profile after uniform charging in the present invention.
Figure 3B:
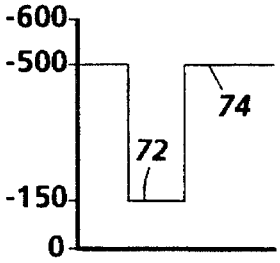
FIG. 3B shows the photoreceptor voltage profile after an exposure step in the present invention.

The voltage profiles on the photoreceptor 10 depicting the multi-color image formation steps of the present invention as described with reference to FIGS. 1 and 2, are illustrated in FIGS. 3A through 3M. It is understood, however, that the voltages depicted with reference to FIGS. 3A through 3M are illustrative only, and that other voltage levels could be used with the single positive recharge step of the present invention. FIG. 3A illustrates the voltage profile 68 on photoreceptor belt 10 after the belt surface has been uniformly charged. The photoreceptor is initially charged to a voltage slightly higher than the −500 volts indicated ($V_o$) but after dark decay the $V_{ddp}$ voltage level is −500 volts. After a first exposure as illustrated in FIG. 3B, the voltage profile comprises high and low absolute voltage levels 74 and 72, respectively. The level 74 at the original −500 volts represents the background area for the first image development step, and the level 72 at −150 volts (FIG. 3B) represents the area discharged by the laser 24 and corresponds to the image area to be developed by a single color toner.

Figure 3C:
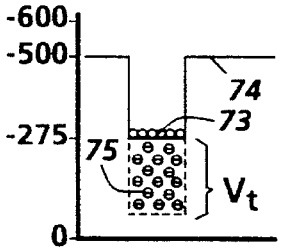
FIG. 3C shows the photoreceptor voltage profile after a development step subsequent to the exposure step of FIG. 3B in the present invention.
Figure 3D:
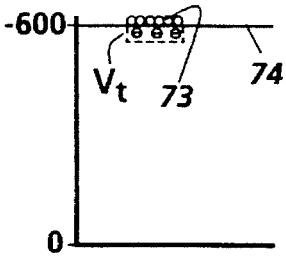
FIG. 3D shows the photoreceptor voltage profile after a first recharging step in the present invention.

During the first development step, black colored toner adheres to the DAD image area and causes the photoreceptor in the image area to be increased to approximately −275 volts (FIG. 3C). The toner particles 73 have a negative charge 75 associated therewith.

When the black toned regions 73 and untoned regions 74 of the photoreceptor are subjected to a first recharging step (FIG. 3D), corona recharge device 36 charges both regions 73 and 74 to a slightly higher level, e.g. −600 volts, than the original $V_{ddp}$ of −500 volts.

Figure 3E:
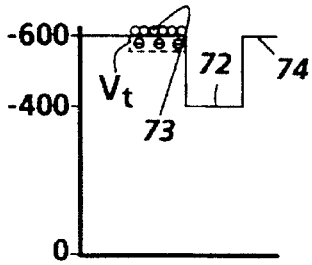
FIG. 3E shows the photoreceptor voltage profile after a second exposure step in the present invention.
Figure 3F:
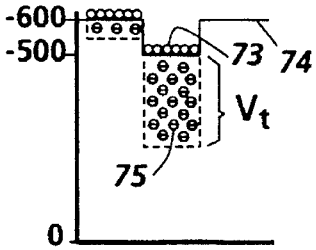
FIG. 3F shows the photoreceptor voltage profile after a second development step of a first non-black color toner in the present invention.

During a second exposure step as illustrated in FIG. 3E, those image areas to be developed with the next color toner are discharged to approximately −400 volts. During a second development step of a first non-black color toner, e.g. yellow, as illustrated in FIG. 3F, the yellow colored toner adheres to the DAD image area and causes the photoreceptor in the image area to be increased to approximately −500 volts (FIG. 3F). The yellow toner particles 73 have a negative charge 75 and a residual voltage $V_t$ associated therewith.

Figure 3G:
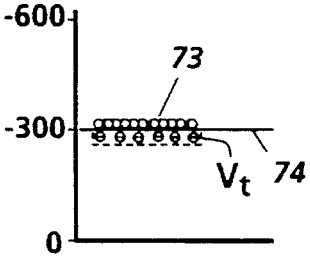
FIG. 3G shows the photoreceptor voltage profile after a single positive recharging step in the present invention.

As illustrated in FIG. 3G, corona recharge device 51 delivers a positive current to the image areas 73 and background areas 74 of the photoreceptor, whereby both areas are brought to a uniform and lower absolute level of, for example −300 volts. This single positive recharge step of the present invention enables a substantial reduction of the residual voltage $V_t$ associated with the toner image 73, without having to apply a negative charge to the toner layer. The difference between the potential associated with the developed image 73 before the single positive recharge step (FIG. 3G) and the photoreceptor potential after recharge (−300 volts) should be adequate to ensure that sufficient positive charge is applied to the negatively charged image 73 during recharge, and is preferably in the range of 100 to 350 volts.

Figure 3H:
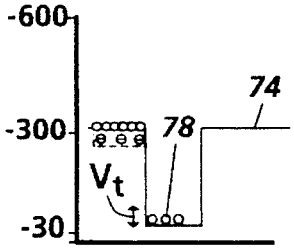
FIG. 3H shows the photoreceptor voltage profile after a third exposure step in the present invention.
Figure 3I:
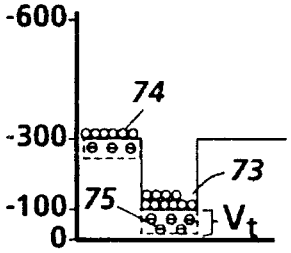
FIG. 3I shows the photoreceptor voltage profile after a third development step of a second non-black color toner in the present invention.
Figure 3J:
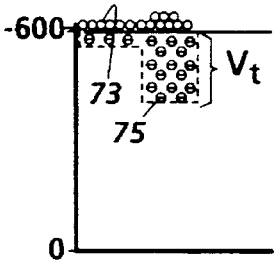
FIG. 3J shows the photoreceptor voltage profile after the first part of a split recharging step in the present invention.
Figure 3K:
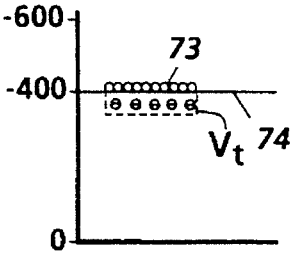
FIG. 3K shows the photoreceptor voltage profile after the second part of a split recharging step in the present invention.

During a third exposure step as illustrated in FIG. 3H, the image areas to be developed with the next color toner are discharged in superimposed registration with either previously toned areas or bare untoned areas, depending on the particular color sequencing of the full color image to be reproduced. Those previously untoned image areas to be developed with the next color toner are discharged to approximately −30 volts. Previously toned areas are discharged to a level increased by its associated $V_t$. During a third development step of a second non-black color toner, e.g. magenta, as illustrated in FIG. 31, the magenta colored toner adheres to the DAD image area and causes the photoreceptor in the image area to be increased to approximately −100 volts. The magenta toner particles 73 have a negative charge 75 and a residual voltage $V_t$ associated therewith.

The toned regions 73 and untoned regions 74 of the photoreceptor are then subjected to the first recharging step (FIG. 3J) of the split recharge process described with reference to FIG. 1. During this first step, the first corona recharge device 61 overcharges the toned 73 and background areas 74 of the photoreceptor to a negatively higher level than $V_o$ or the ultimately desired $V_{ddp}$. Thus, after passing the first corona recharge device, the photoreceptor surface having the developed image thereon is charged to approximately −600 volts and the toner particles 73 still have a negative charge 75 and a residual voltage $V_t$ associated therewith. Preferably, the second corona recharge device 62 is a voltage sensitive device that delivers an alternating current to the photoreceptor surface to lower the photoreceptor potential to a uniform level of approximately $V_{ddp}$ of −400 volts (FIG. 3K) and substantially neutralizes the toner particles 73. A minimal residual voltage $V_t$ is associated with the developed image. A voltage sensitive corona recharge device whose graph of the output current (I) to the photoreceptor surface as a function of the voltage to the photoreceptor surface (V) has a high characteristic (I/V) slope, used for recharging a photoreceptor having a toner image developed thereon, is described in copending application for U.S. Patent titled "Method and Apparatus for Reduced Residual Toner Voltage", Ser. No. 08/347,616 having a common assignee as the present application, the relevant portions of which are hereby incorporated by reference herein.

Figure 3L:
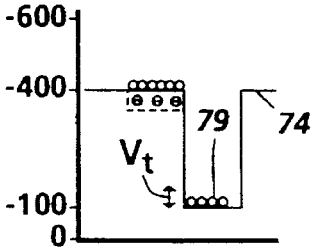
FIG. 3L shows the photoreceptor voltage profile after a fourth exposure step in the present invention.
Figure 3M:
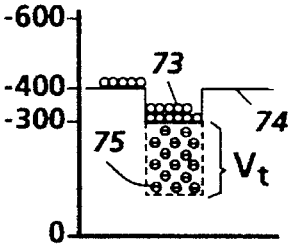
FIG. 3M shows the photoreceptor voltage profile after a fourth development step of a third non-black color toner in the present invention.

After this split recharge step (FIGS. 3J and 3K), the photoreceptor is uniformly charged, the residual toner voltage associated with the previously developed toner layer is substantially reduced, and the toner charge at the top of the toner layer is substantially neutralized. The photoreceptor is again ready for image formation thereon. As illustrated in FIG. 3L, those bare areas and image areas 79 to be developed thereon by a fourth color (third non-black color) toner, are discharged by an exposure device. Those previously untoned image areas to be developed with the next color toner are discharged to approximately −100 volts. Previously toned areas are discharged to a level increased by its associated $V_t$. Development of those image areas 79, as illustrated in FIG. 3M, raises the associated voltage to approximately −300 volts.

While the foregoing description was directed to a color printer where a full color image is built in a single pass of the charge retentive surface, it will be appreciated that the invention may also be used in a multiple pass system, as well as in a single or multiple pass highlight color process machine.

What is claimed is:

1. A printing machine comprising:

a charge retentive surface having a developed image thereon, the developed image having an electrical potential of a first magnitude associated therewith; and a corona generating device for recharging said charge retentive surface and the developed image to an electrical potential which has a magnitude less than said first magnitude.

2. The printing machine according to claim 1, further comprising a direct current source coupled to said corona generating device.

3. The printing machine according to claim 2, wherein said corona generating device comprises:

a coronode wire; and a grid interposed between said charge retentive surface and said coronode wire.

4. The printing machine according to claim 1, wherein said corona generating device is voltage sensitive.

5. The printing machine according to claim 1, wherein said corona generating device recharges the charge retentive surface to an electrical potential within a range from about 100 volts to about 350 volts of the electrical potential associated with the developed image.

6. The printing machine according to claim 1, further comprising means for exposing onto said charge retentive surface after said corona generating device recharges said charge retentive surface to record an image area thereon.

7. The printing machine according to claim 6, further comprising means for developing the image area to form a subsequent developed image area in superimposed registration with the first mentioned developed image area.

8. The printing machine according to claim 7, wherein the first mentioned developed image and the subsequent developed image are formed during one revolution of said charge retentive surface.

9. The printing machine according to claim 7, wherein the first mentioned developed image is of a different color than the subsequently developed image.

10. The printing machine according to claim 7, wherein the first mentioned developed image is developed with a non-black color toner.

11. The printing machine according to claim 7, wherein the charge retentive surface having the first mentioned developed image and the subsequently developed image thereon are recharged by a corona generating apparatus, wherein an electrical charge associated with the first mentioned developed image and the subsequently developed image is substantially neutralized.

12. A method for creating an image on a charge retentive surface, comprising:

developing an image area on the charge retentive surface, the developed image area having an electrical potential of a first magnitude associated therewith; and recharging the charge retentive surface to an electrical potential which has a magnitude less than said first magnitude.

13. The method for creating an image according to claim 12, wherein the recharging step comprises using a voltage sensitive corona generating device.

14. The method for creating an image according to claim 12, wherein the recharging step further comprises delivering a direct current to the charge retentive surface.

15. The method for creating an image according to claim 12. wherein the recharging step charges the charge retentive surface to an electrical potential within a range from about 100 volts to about 350 volts of the electrical potential associated with the developed image.

16. The method for creating an image according to claim 12, further comprising the step of re-exposing the charge retentive surface after said recharging step to record a subsequent image area.

17. The method for creating an image according to claim 16, further comprising the step of developing the subsequent image area to form a subsequent developed image area in superimposed registration with the first mentioned developed image area.

18. The method for creating an image according to claim 17, wherein the step of developing the first mentioned image area and the step of developing the subsequent image area occur in one revolution of the charge retentive surface.

19. The method for creating an image according to claim 17, wherein:

the step of developing the subsequent image area forms the subsequent developed image area in superimposed registration with the first mentioned developed image area.

20. The method for creating an image according to claim 17, further comprising the steps of:

recharging the charge retentive surface having the first mentioned developed image and the subsequent developed image thereon; and substantially neutralizing an electrical charge associated with the first mentioned developed image area and the subsequent developed image area.

21. The method for creating an image according to claim 17, wherein the first mentioned developed image area is developed with a different color toner than the subsequently developed image area.

22. The method for creating an image according to claim 21, wherein the first mentioned developed image area is developed with a non-black color toner.

23. A printing machine comprising:

a charge retentive surface having a developed image thereon, the developed image having an electrical potential associated therewith;

a corona generating device for recharging said charge retentive surface and the developed image to a lower electrical potential than the electrical potential associated with the developed image;

means for exposing said charge retentive surface alter said corona generating device recharges said charge retentive surface to record an image area thereon; and means for developing the image area to form a subsequent developed image area in superimposed registration with the first mentioned developed image area;

wherein the charge retentive surface having the first mentioned developed image and the subsequently developed image thereon are recharged by a corona generating apparatus.

24. A method for creating an image on a charge retentive surface, comprising:

developing an image area on the charge retentive surface, the developed image area having an electrical potential associated therewith; and recharging the charge retentive surface to a lower electrical potential than the electrical potential associated with the developed image;

re-exposing the charge retentive surface after said recharging step to record a subsequent image area;

developing the subsequent image area to form a subsequent developed image area in superimposed registration with the first mentioned developed image area;

recharging the charge retentive surface having the first mentioned developed image and the subsequent developed image thereon; and substantially neutralizing an electrical charge associated with the first mentioned developed image area and the subsequent developed image area;

wherein an electrical charge associated with the first mentioned developed image and the subsequently developed image is substantially neutralized.

* * * * *